United States Patent [19]

von Schuckmann

[11] 4,117,956

[45] Oct. 3, 1978

[54] RECEPTACLE FOR THE PORTIONED DISPENSING OF THE CONTENTS THEREOF

[76] Inventor: Alfred von Schuckmann, Nordstrasse 32 a, 5657 Haan, Fed. Rep. of Germany

[21] Appl. No.: 765,247

[22] Filed: Feb. 3, 1977

[30] Foreign Application Priority Data

Feb. 9, 1976 [DE] Fed. Rep. of Germany ... 7603602[U]
Aug. 25, 1976 [DE] Fed. Rep. of Germany ..... 2638164

[51] Int. Cl.[2] ..... G07F 11/00
[52] U.S. Cl. ..... 221/288; 221/303
[58] Field of Search ..... 221/232, 263, 266, 268, 221/270, 272, 279, 280, 312 R, 288, 186, 188, 246, 187, 190, 197, 247, 250, 303, 202, 204, 301; 222/454–456

[56] References Cited

U.S. PATENT DOCUMENTS 2,962,190 11/1960 Horland ..... 221/263
3,162,322 12/1964 Gilbertson ..... 221/270
3,398,857 8/1968 Alio ..... 221/288

FOREIGN PATENT DOCUMENTS 331,422 7/1930 United Kingdom ..... 221/186

*Primary Examiner*—Stanley H. Tollberg
*Assistant Examiner*—H. Grant Skaggs
*Attorney, Agent, or Firm*—Martin A. Farber

[57] ABSTRACT

A receptacle for the portioned dispensing of the contents thereof characterized in that two channels in the receptacle are coordinated to a cover-sided exit opening of the receptacle, of which one of the channels which is adjusted to the size of the tablets and which extends from a storage space in the receptacle extends cross-wise to the exit opening, and whereas the other of the two channels lies cross-wise relative to the first-mentioned cross channel and runs in the longitudinal direction of the exit opening. A deadweight division slider is displaceably disposed in the longitudinal second-mentioned channel.

12 Claims, 5 Drawing Figures

RECEPTACLE FOR THE PORTIONED DISPENSING OF THE CONTENTS THEREOF

The invention relates to a receptacle with means for portioned dispensing of contents comprising tablets, pills or the like.

Slider-displaceable receptacles are known, the exit opening of which is dimensioned somewhat larger than the individual size of the contents to be given. With these known forms of construction, individual removal of the contents is not attained with sufficient guarantee. Indeed these receptacles are formed extremely flat so that behind the individual piece which lies closest to the exit opening no second can stack; however in spite of this it occurs that further pieces leave the exit opening since sufficient dexterity or skill is lacking to again timely close the slider manually.

It is an object of the present invention, that is particularly in addition to that which may be derived from the specification and claims, to provide a container of the generic type for the portioned dispensing of its contents comprising for example tablets, in a technically simple manner of production, security of use as well as a simplified handleable construction such that the portioned removal of the tablets is effected alone by itself on the basis of a position change of the receptacle.

As a result of such formation as illustrated in the drawings and claims, a receptacle of increased security of the individual dispensing discharge is provided. The individual discharge removal of the contents no longer takes place slide controlled by hand or manually, but rather by a gravitional weight- or deadweight-displaceable division slider. The receptacle need only to be brought from its normal standing position into the tipping position (thus as one pours out a cup). The corresponding construction form is most exceptionally foolproof. Practically no possibility exists in the sense of a false operation or service. The construction means are simple and completely service-free. The cross channel which communicates with the storage space of the container runs substantially perpendicularly to the longitudinal channel guiding the division slider; the exit opening also lies in the direction of extension of the longitudinal channel. By the corresponding position of the channels with respect to one another, the filling contents in the form of one individual tablet arrives with security in the proper issuance position prior to the sliding of the deadweight-displaceable division slider in the direction of the exit opening upon further tipping, and in this manner the tablet slides out with an accompanying blocking of the cross channel. This division slider momentarily steps back with release or opening of the channel if the receptacle is again brought into its normal standing position. Since the cross channel then stands in the horizontal position, above all with edged (polygonal-shaped) filling contents, the next succeeding tablet is prevented from falling out of the cross channel. With rollable contents the cross channel can also be formed slightly tapering i.e. slanting away in the discharge direction. The length of the cross channel is a contributory factor in the extent in which a storage formation takes place in the direct range of the exit opening. In order to obtain a pre-orientation of the contents of the receptacle with respect to the cross channel, a magazine or stacker shaft which opens along the entire length into the storage space is pre-arranged in front of the cross channel. By an arrangement of the cross channel in the cover range of the receptacle, the entire height of the receptacle can practically be used for formation of this magazine shaft. Guide walls which diverge with respect to one another extend from the edge of this magazine shaft, the guide walls also forming the boundary walls of the storage space of the container. With respect to this, the alignment of the guide walls lead to a V-shaped valley-type cross-section. The steeper the guide walls are aligned, the quicker does the proper exiting alignment of the tablets take place. On the one hand, in order to obtain a relatively large useable receptacle volume, and on the other hand, to obtain a length of the cross channel which is serviceable or helpful to the storage formation, the exit opening lies in the range of a widening of the receptacle, which widening leads to a drop-shaped cross-section of the receptacle, the latter being designed substantially cylindrically as to its remainder.

In order to limit the displacement path of the division slider, the latter is provided with an abutment stop wing, which projects in one side space of the longitudinal channel, which side space corresponds to the length of the displacement. A particularly disturbance-free operation is achieved with simultaneous realization of a certain aid in orientation, in the manner that the division slide has an inclined surface tapering toward the forward thrust-face surface on the side flank of the slider which faces the cross channel.

With one formation, in which the cross channel extends directly behind the cover surface of the receptacle, the cover itself is included in advantageous manner in the formation of the cross channel. The same holds analogously for the embodiment with which the cross channel is arranged in the vicinity of the bottom of the receptacle. Here the division slider on its rearward end forms a step-shaped off-set division head which steps in front of the cross channel. With this embodiment also the bottom surface itself still is used as the limit abutment for the deadweight-displaceable division slider. An advantageous construction with respect to the useable volume as well as to the conversion to other sizes of the portioned contents to be discharged is achieved in the manner that the cross channel and the longitudinal channel are formed on an insert part of the receptacle. This has also the considerable advantage that the receptacle can be used without insert, still as a refill package and indeed as a powder package. The guide walls which are moreover attached or adjusted to the insert part bring, together with the selected non-round cross-sectional shape of the receptacle, a stable-in-use securing of the insert in the inside of the receptacle. After insertion of the cover having the exit opening, which cover can be advantageously coordinated in any manner of choice, for example by catching or recesses, or detachable adhesive tape or the like, the assembly is completed. The division slider is held solely on the basis of a form-closed or positive mounting storage.

With the above and other objects and advantages in view, the present invention will become more clearly understood from the following detailed description of preferred embodiments of the present invention when considered with the accompanying drawings, of which:

Figure 1:
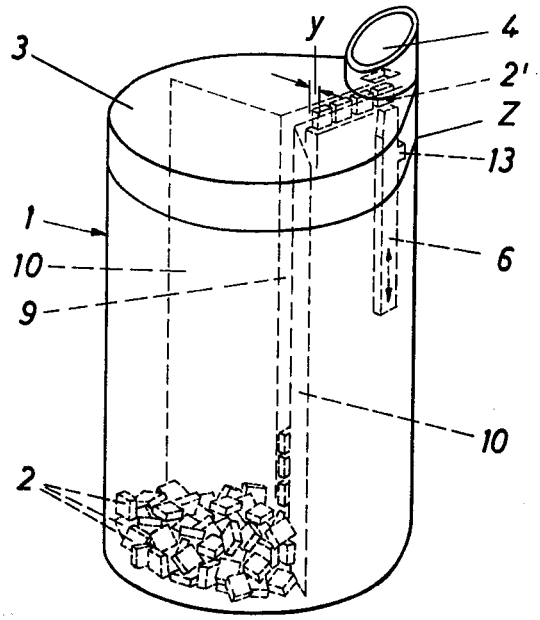
FIG. 1 is a perspective view of a receptacle for portioned dispensing of for example tablets according to a first embodiment of the present invention.

Referring now to the drawings, the receptacle 1 for portioned individual or single dispensing of, for example tablets 2, is covered by a cover 3 at the upper side. This cover 3 is attached to a pour-like removal or discharge opening 4.

Figure 2:
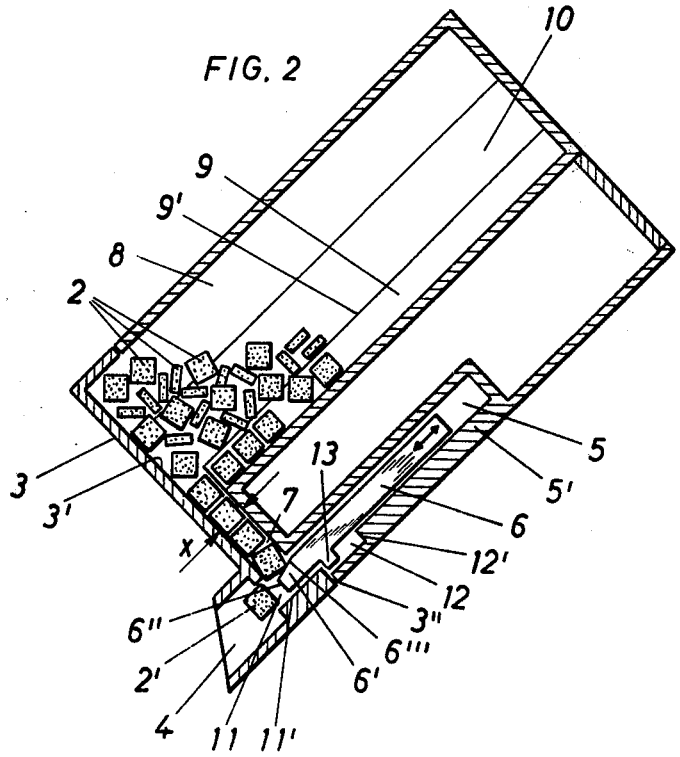
FIG. 2 is a vertical section through the container of FIG. 1 when in the dispensing position.

In the axial direction relative to the exit opening 4 there extends a longitudinal channel 5 on the inside of the receptacle. A gravitional weight- or deadweight-displaceable subdivision slide 6 is received in the longitudinal channel 5. In a forward-stepped position, the head 6' of the subdivision slide 6 extends or projects in front of a channel 7, the latter extending transversely relative to the channel 5, such that the the head 6' basically essentially closes or locks the cross channel 7, the latter being adjusted complementarily to the size of the tablets. The cross channel 7 originates from the storage space 8 of the receptacle. A magazine or stacker shaft 9 is connected and communicates with the cross channel 7. The shaft 9 extends parallel to the longitudinal channel 5. The shaft 9 extends over the entire length of the receptacle. Also this shaft 9 is adjusted or complementary to the size of the tablets. The edge 9' of the shaft 9 transfers in diverging directed guide walls 10. The latter also form the boundary or limit walls of the storage space or area 8 of the receptacle. The angle of divergence is chosen such that in the dispensing position illustrated in FIG. 2, the tablets slide down from the guide walls 10 and arrange themselves in the magazine or stacket shaft 9 as illustrated. In the dispensing position illustrated in FIG. 2, these arranged tablets are guided to drop in the direction of the cross-sectionally equal transverse channel 7. Here a supply is formed corresponding to the length of the cross channel 7, which also remains there when the receptacle is brought into the standing position as illustrated in FIG. 1. In the latter position also some tablets remain standing in the magazine shaft 9. Now if the receptacle is tipped into the dispensing position, the forward-most lying tablet 2' drops into the dispensing chamber 11 with the proper charging displacement of the container, since the effective tipping position of the cross channel 7 leads, or comes in advance of that of the longitudinal channel 5. The forward-most tablet 2' enclosed in the dispensing chamber 11 completely fills up the chamber 11 and stops the entrance of a further tablet. The load of the tablets that lies therebehind presses the tablet 2' against the wall 11' of the chamber 11. With the continuing increasing tipping displacement of the container, now also the deadweight or gravity-shifting division slide which acts as the ejector- or knock-out-ram, slides forward in the direction of the dispensing opening and with its thrust-front surface 6'' knocks outs the forwardmost lying tablet 2', simultaneously holding back the next tablet 2. In order to guarantee the prevention of a clamping and jamming or blocking, above all with edged tablets, the side flank of the division slide 6, which side flank points to the cross channel 7, is inclined tapering off in a direction toward the front thrust-face surface thereof. This corresponding inclined surface is designated with the reference character 6'''. If the container is now brought again into the standing position according to FIG. 1, the division slide 6 falls back with release of the dispensing chamber 11. Depending on the back-up or pile-up pressure of the tablets, the next tablet may already then fall into the dispensing chamber 11, which on the channel innerside is closed by the thrust-front surface of the division channel. The next dispensing process is preformed as illustrated.

By the embodiment in accordance with the present invention the radially directed cross channel 7 extends approximately to the center of the receptacle. With the illustrated dimensional proportions, this cross channel 7 receives tablets as a direct storage or supply. This is again completed or filled with each dispensing. Also the magazine or stacker shaft 9 uniformly contains a minimum supply of tablets 2 which are arranged properly for dispensing. With tipping of the receptacle these fall.

Figure 4:
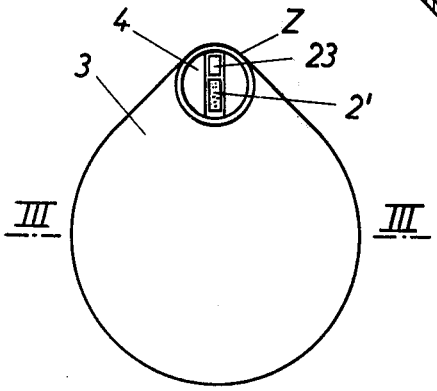
FIG. 4 is a plan view of the container of FIG. 3.

On the one hand in order to have a relatively large length for the cross channel for availability or disposition and on the other hand to compel a certain manner of use by the form, the fall-out opening 4 and the longitudinal channel 5 lie edge-sided in a widened zone Z, the latter leading to a drop-shaped receptacle, cross-section, the zone Z being a widened zone Z of the receptacle, the latter being held cylindrical in cross-section as to the remainder (compare FIG. 1 and FIG. 4).

This widening Z provides yet also a type of stabilizing rib, in any case a zone shape of greater stability. This zone is also used for the accomodation of the slider 6 which forms the knock-out ram. The peripheral channel wall section 5' which circumscribes the longitudinal channel 5 moreover is constructed thickened relative to the remaining wall sections. This thickened wall section forms a side space 12 for an abutment wing 13. The length of the laterally opened space 12 corresponds to the displacement path of the division slide 6 and at least to the height or width $x$ of the cross channel 7. The wing 13 steps at one end against the side space shoulder 12' and at the other end against the front edge 3'' of the cover, respectively.

The cross channel 7 extends directly behind the inner-sided cover surface 3', so that the latter forms one of the four walls of the channel.

Figure 3:
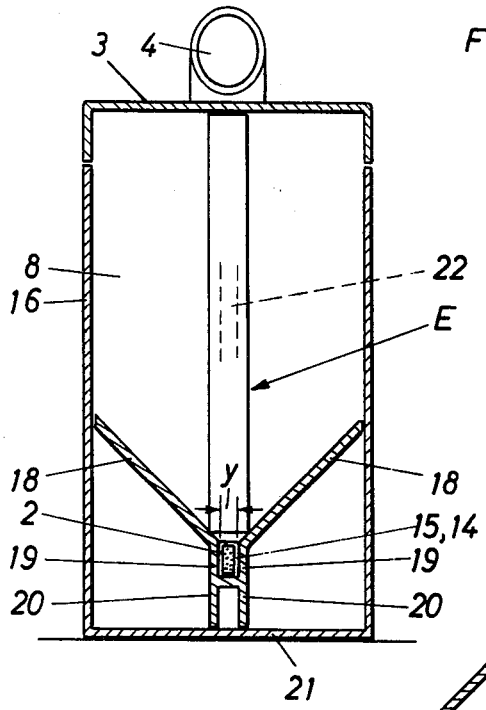
FIG. 3 is a sectional view taken along the lines III—III of FIG. 4 of a receptacle in accordance with a second embodiment.
Figure 5:
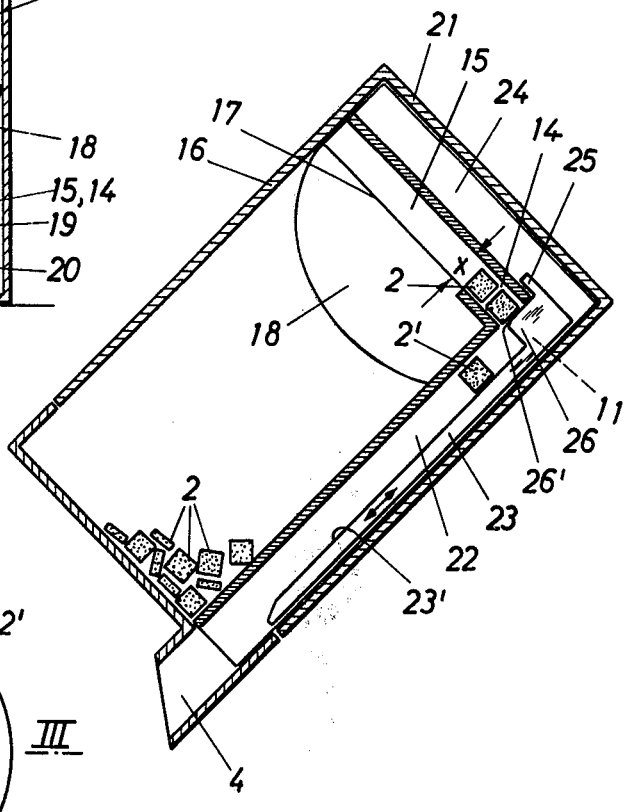
FIG. 5 is a section through the container of FIG. 3 in the dispensing position.

Referring now to the drawing and more particularly to FIGS. 3–5, in accordance with a second embodiment example of the invention, a cross channel 14 is provided in the bottom range of the receptacle or container. The cross channel 14 continues into the magazine or stacker shaft 15, the latter connecting in the same alignment. The magazine shaft 15 terminates before the container or receptacle wall 16. Also here guide walls 18 extend from the edge 17 of the shaft 17, which guide walls 18 form the V-shaped valley as evident from FIG. 3. The side walls 19 which form the cross channel continue into coplanar aligned support walls 20. The latter sit on the bottom 21 of the receptacle.

The cross channel 14 and the longitudinal channel 22 are formed in an insert part E. The latter is supported outwardly over support walls 20 also still by means of the guide walls 18 on the receptacle walls 16. The longitudinal channel is designed in the shape of a U-profile, the leg-front surfaces of which likewise step against the receptacle wall 16, which also is drawn on or used for the guiding for the division slide 23, the latter serving as the knock-out ram.

This division slide performs the same function as that described in the first embodiment. It has an abutment wing 25 which projects in a side channel 24. One of the abutment edges with this is the bottom lower side of the cross channel and the other constitutes the bottom of the receptacle. The division head 26 connects directly on the part of the slide which forms the abutment wing. The division head 26 is bevelled or inclined at portion 26' thereof. Also here the head essentially closes the entire cross-section of the channel. The length of the side space 24 is so dimensioned that the division head 26 completely releases or opens the cross channel for the exit of the then present forwardmost tablet 2', which slides outwardly in the dispensing position according to FIG. 5 on the inner flank 23' of the slider 23, the latter being drawn forward up to the range of the exit opening 4.

The length of the cross channel 14 is so dimensioned that two tablets stand ready as a direct dispensing supply. The chute as clearly illustrated in the drawing is inclined or bevelled.

The non-round cross-section of the receptacle causes a non-rotatable position fixing of the merely freely inserted insert, which is fixed also in the longitudinal direction after putting on the cover.

I claim:

1. A receptacle for the portioned dispensing of contents including for example tablets, pills or the like, comprising a receptacle defining a storage space and a cover end and formed with an exit opening at the cover end, the receptacle having formed therein two channels operatively communicating with said exit opening, walls completely surrounding and defining one of said channels, the latter being substantially complementary in cross-section to the size of the tablets and having a length equal to at least two tablets, said one channel communicating with and extending from said storage space in the receptacle and extending cross-wise to the exit opening, the other of said two channels extending cross-wise relative to said one channel communicating therewith and extending in a longitudinal direction of said exit opening directly communicating with the latter, and a deadweight division slider means for being disposed freely slidable in said other channel exclusively by gravity upon moving said receptacle into a tipping dispensing position with the exit opening pointing downwardly and into a neutral position with the exit opening pointing upwardly, respectively, blocking and unblocking communication between said channels, respectively, said walls defining said one channel constituting means for forming and maintaining a direct tandem supply of tablets therein during the tipping dispensing position and as well as during the neutral position of the receptacle, respectively.

2. The receptacle according to claim 1, further comprising a magazine shaft along a full longitudinal length thereof opening into and communicating with said storage space, and said magazine shaft communicates at a front portion with said one channel, said magazine shaft defining edges, side walls extend from the edges of said magazine shaft, said side walls extend divergingly relative to one another, said side walls constitute boundary walls of said storage space in the receptacle.

3. The receptacle according to claim 1, wherein said receptacle is formed partially with a tear-shaped cross-section and a remaining cylindrical cross-section, said receptacle including a widening portion leading to said tear-shaped cross-section, and said exit opening extends in the range of said widening portion.

4. The receptacle according to claim 1, further comprising a cover disposed on said receptacle at said cover end and formed with said exit opening, said cover has an inner front edge, second walls form said other channel defining an adjacent side space as well as a side space shoulder spaced apart from said front edge of said cover, said side space being between said frong edge and said shoulder, said division slider means has an abutment wing, said abutment wing projects into said side space of said other channel displaceably between said shoulder and said front edge of said cover, respectively, said side space defines a displacement length of said division slider means.

5. The receptacle according to claim 1, wherein said division slider means has a front thrust - face surface facing said exit opening and a side flank facing said one channel, said side flank has an inclined surface tapering toward said front thrust-face surface thereof.

6. The receptacle according to claim 1, wherein said one channel extends directly behind a cover surface of the receptacle, said cover surface constitutes a portion of said walls.

7. The receptacle according to claim 1, wherein said one channel is disposed in a bottom vicinity of said receptacle, and said division slider means has a rearward end forming a division head slidably moveably stepping in front of said one channel, and said division head is formed in the shape of at least one step.

8. The receptacle according to claim 7, wherein the receptacle defines a longitudinally extending peripheral wall enclosed but non-round in cross-section and a bottom end remote from said cover end, an insert part is inserted in said peripheral wall, said insert part includes:

two parallel walls having a free end supported on said bottom end of the receptacle;

said first-mentioned walls, defining said one channel, constitute:

upper portions of said two parallel walls, the latter having uppermost ends, a horizontal wall is connected to said parallel walls, said two parallel walls and said horizontal wall defining an H-shaped cross-section, a second wall parallel to said horizontal wall is connected to the uppermost ends of said two parallel walls, said one channel being defined between an upper portion of the H-shaped cross-section and said second wall, said second wall extends from said other channel and has a length substantially equal to the length of two tablets, said horizontal wall, said parallel walls and said bottom end defining a bottom side space;

said horizontal wall has a free end contiguous to said other channel, said horizontal wall extends from said other channel to said peripheral wall on an opposite side of the receptacle, an additional wall is connected perpendicularly to said second wall and extends parallel and adjacent to said peripheral wall abutting said cover end and defining said other channel therebetween, guide walls attached to the uppermost ends of said parallel walls, respectively, extending divergingly therefrom to opposite portions of said peripheral wall, said deadweight division slider means has an abutment wing facing said bottom end, connected to said division head at a lowermost end thereof and displaceably projects under said horizontal wall between said parallel walls into said bottom side space, said deadweight division slider means includes an extension connected to said division head and extending parallel to said additional wall and spaced therefrom by a distance slightly greater than the size of the tablets, said division head includes a thrust surface facing toward said exit opening and a blocking surface perpendicular to said thrust surface, said blocking surface substantially equal in length to the cross-section of said one channel and disposed adjacent to the free end of said horizontal wall so as to close off communication between said one channel and said other channel when the receptacle is tipped in the dispensing position with said aubtment wing contacting said horizontal wall, said horizontal wall is spaced from the bottom end of said receptacle by a distance with respect to the length of said blocking surface and the thickness of said abutment wing, such that said blocking surface completely is longitudinally spaced away from and opens said one channel with said blocking surface disposed adjacent said bottom side space between said horizontal wall and said bottom end when said abutment wing contacts said bottom end of the receptacle constituting the neutral position.

9. The receptacle according to claim 1, further comprising an insert part inserted in said receptacle, and said one channel and said other channel are formed on said insert part.

10. The receptacle according to claim 9, further comprising guide walls attached to said insert part.

11. The receptacle according to claim 1, wherein said receptacle includes a base adapted to stand on a surface in the neutral position, said one channel is substantially horizontal in the neutral position relative to said base.

12. The receptacle according to claim 1, further comprising a cover disposed on said receptacle at said cover end and formed with said exit opening, said cover has an inner front edge, said one channel extends horizontally adjacent to said cover, second walls form said other channel defining an adjacent side space as well as a side space shoulder spaced apart from said front edge of said cover, said side space being between said front edge and said shoulder, said division slider means has an abutment wing, said abutment wing projects into said side space of said other channel displaceably between said shoulder and said front edge of said cover, respectively, said side space defines a displacement length of said division slider means, said division slider means has a front thrust-face surface facing said exit opening and a side flank facing said one channel, said side flank has an inclined surface tapering toward said front thrust-face surface thereof, said inclined surface has a length such that said inclined surface is adjacent said one channel blocking the latter when said abutment wing abuts said front edge in the tipping dispensing position, said inclined surface and said front thrust-face surface are disposed spaced below said one channel when said abutment wing abuts said shoulder in the neutral position, said other channel includes a portion thereof laterally adjacent said one channel forming a dispensing chamber substantially complementary to the size of one of the tablets, a magazine shaft substantially complementary in cross-section to the size of the tablets disposed parallel to said other channel and along a full longitudinal length thereof opening into and communicating with said storage space, and said magazine shaft communicates with one end of said one channel adjacent said cover, said magazine shaft defining edges, side guide walls extend from the edges of said magazine shaft, said side guide walls extend divergingly relative to one another, said side guide walls constitute boundary walls of said storage space in the receptacle.

* * * * *